US010583964B2

(12) United States Patent
Troost

(10) Patent No.: US 10,583,964 B2
(45) Date of Patent: Mar. 10, 2020

(54) BAG WITH GUSSET ARRANGEMENT TO RESIST TEAR

(71) Applicant: Peel Plastic Products Limited, Brampton (CA)

(72) Inventor: William Troost, Toronto (CA)

(73) Assignee: Peel Plastic Products Limited, Brampton, Ontario (CA)

( * ) Notice: Subject to any disclaimer, the term of this patent is extended or adjusted under 35 U.S.C. 154(b) by 156 days.

(21) Appl. No.: 15/159,806

(22) Filed: May 20, 2016

(65) Prior Publication Data

US 2016/0340084 A1 Nov. 24, 2016

Related U.S. Application Data

(60) Provisional application No. 62/165,176, filed on May 21, 2015.

(51) Int. Cl.
*B65D 30/20* (2006.01)
*B65D 33/25* (2006.01)

(52) U.S. Cl.
CPC ..... *B65D 31/10* (2013.01); *B65D 33/2591* (2013.01)

(58) Field of Classification Search
CPC ..... B65D 31/10; B65D 75/5866
USPC ..... 383/120
See application file for complete search history.

(56) References Cited

U.S. PATENT DOCUMENTS 4,055,109 A * 10/1977 Kan ..... B65D 75/008 493/196
4,759,639 A * 7/1988 DeMatteis ..... B65D 33/001 206/554
2009/0175565 A1* 7/2009 Totani ..... B65D 31/10 383/120
2010/0014790 A1* 1/2010 Colla ..... B31B 19/00 383/120
2010/0142858 A1* 6/2010 Kruse ..... B65D 31/10 383/5
2010/0266223 A1* 10/2010 Lin ..... B65D 31/02 383/78
2010/0290722 A1* 11/2010 DeSmedt ..... B65D 31/10 383/120

FOREIGN PATENT DOCUMENTS

JP 2013100140 A * 5/2013
JP 2014184982 A * 10/2014

OTHER PUBLICATIONS

JP2014184982Translation.*
JP2013100140Translation (Year: 2013).*

* cited by examiner

*Primary Examiner* — Jes F Pascua
*Assistant Examiner* — Nina K Attel
(74) *Attorney, Agent, or Firm* — Stuart L. Wilkinson

(57) ABSTRACT

A bag of plastic film material has a side gusset between front and back panels, the top of the gusset spaced from the top of the bag. The front and back panels are seamed to each other above the gusset to present a side edge having an orientation. The top edge of the gusset extends non-orthogonally to the orientation of the side edge.

10 Claims, 2 Drawing Sheets

BAG WITH GUSSET ARRANGEMENT TO RESIST TEAR

CROSS REFERENCE TO RELATED PATENTS

The present U.S. Utility Patent Applications claims priority pursuant to 35 U.S.C. 119(e) to U.S. Provisional Patent Application Ser. No. 62/165,176, entitled "BAG WITH GUSSET ARRANGEMENT TO RESIST TEAR" filed May 21, 2015.

FIELD OF THE INVENTION

This invention relates to a bag and particularly to a bag gusset arrangement for resisting tearing.

DESCRIPTION OF RELATED ART

Bags made of plastic or other sheet or film media have value additional to that of carrying things because they are relatively cheap to produce and can generally be stored flat when empty.

One popular form of bag has back and front panels with a side gusset between the panels. For aesthetic and functional purposes, the gusset ends short of the top of the bag, and the bag front and back panels are seamed together above the end of the gusset. Unfortunately, users of such a bag may grab the seamed top part, using it as a rudimentary handle. A common problem with such a design and use is that, absent the use of heavy duty materials, the bag may tear where the gusset terminates.

BRIEF DESCRIPTION OF THE DRAWINGS

For simplicity and clarity of illustration, elements illustrated in the following figures are not drawn to a common scale. For example, the dimensions of some of the elements are exaggerated relative to other elements for clarity. Advantages, features and characteristics of the present invention, as well as methods, operation and functions of related elements of structure, and the combinations of parts and economies of manufacture, will become apparent upon consideration of the following description and claims with reference to the accompanying drawings, all of which form a part of the specification, wherein like reference numerals designate corresponding parts in the various figures, and wherein:

DETAILED DESCRIPTION OF THE INVENTION INCLUDING THE PRESENTLY PREFERRED EMBODIMENTS

Figure 1:
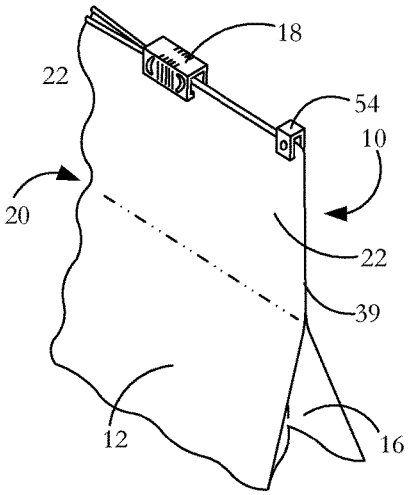
FIG. 1 is an isometric view of an upper corner of a bag according to an embodiment of the invention.
Figure 2:
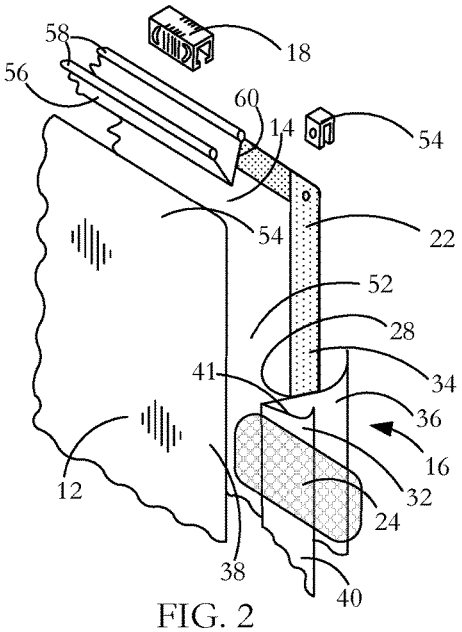
FIG. 2 is a view in exploded view of the elements of the bag upper corner of FIG. 1.

Referring in detail to FIGS. 1 and 2, there is shown an upper corner of a bag 10 having a front panel 12, a back panel 14 and a side gusset 16. The side gusset has an expansible region provided by sides of the gusset. Although not shown, the bag has a matching gusset at the other side of the bag. A closure device 18 is attached at the top of the bag. In the embodiment shown, the closure device is a slide fastener closure but could be any of a number of alternative closure devices including a zip fastener, a Velcro® fastener and a press-to-close fastener.

Figure 3:
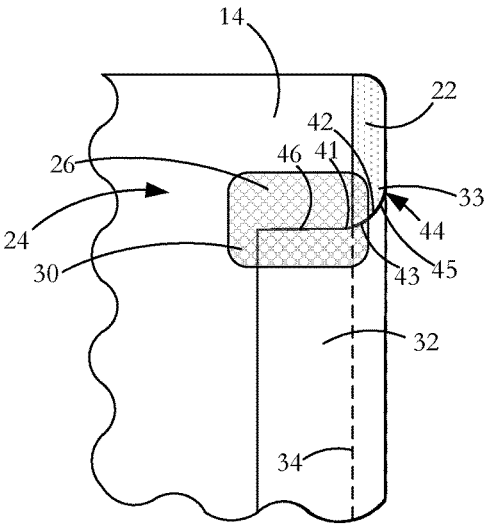
FIG. 3 is a side elevation of a subset of the elements of the bag upper corner of FIG. 1.
Figure 4:
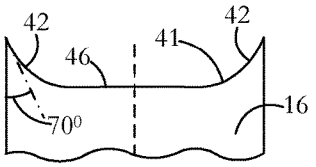
FIG. 4 shows the shape of a gusset top edge according to an embodiment of the invention.

As shown in FIGS. 2 and 3, the side gusset 16 terminates at some distance from the top of the bag. Above the termination, shown generally at 20, top and side edge portions of the front and back panels 12, 14 are welded together at an upper seam region 22. Using a patch 24, an expansible opening provided by sides 28 and 32 of folded gusset 16 is closed off at the termination 20. Above the termination, an upper part 26 of the patch 24 is thermally welded to the back panel 14. Below the termination, the upper part of gusset side 28 is welded to the back panel 14 and the lower part 30 of the patch 24 is welded to an upper part of gusset side 32. Also, below the gusset termination 20, a side edge portion 34 of the back panel 14 is thermally welded to an edge portion 36 of gusset side 28 and a side edge portion 38 of the front panel 12 is thermally welded to an edge portion 40 of gusset side 32. The upper seam arrangement presents an aesthetically pleasing corner configuration at the top of the bag 10 which is mirrored on the other top corner of the bag. Depending on the function and desired appearance of the bag, the terminated gusset design may also be adopted at the bottom of the bag.

When the bag 10 is full and is being lifted and carried, ideally it is done so in a way that does not apply undue stress on any part of the bag to the extent that the bag may be damaged. One way in which a user may lift the bag is by grabbing it at one of its top corners. If the contents of the bag are heavy and if a particularly aggressive lifting movement is applied to the corner, the bag may rip. In this respect, the region of the bag front and back panels 12, 14 just above the gusset termination 20 may be particularly prone to damage. While this problem can be overcome using heavier duty bag film material, this is not a desirable solution owing to additional expense, especially considering that most other parts of the bag may not need to be made with heavy duty material.

Figure 3A:
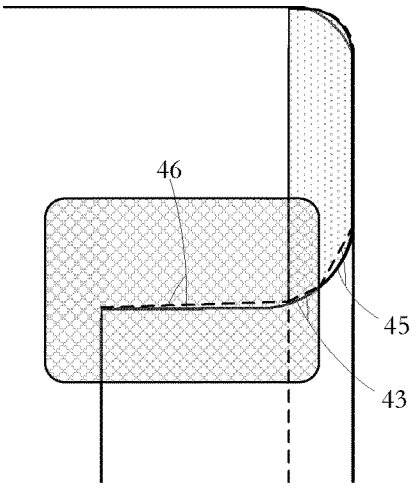
FIG. 3A shows a detail from FIG. 3 to an enlarged scale.

To reduce the chance of the bag front and back panels ripping at the closed top of the gusset 16, the top of the gusset is cut so that portions of the gusset top edge 41 corresponding to each side 28, 32 of the gusset extend non-orthogonally from the side edge 39 of the bag. In the embodiment shown in FIGS. 1 to 4, the two sides of the gusset top edge 41 each have a respective curved portion 42 which, at ends 44, intersect the side edge of the bag at an angle of about 20 degrees to the bag side edge. The curved portions 42 are contiguous with respective straight portions 46 at the inner end of the gusset 16. The gusset top edge 41 has sections 43 located under the patch 24 and sections 45 extending downwardly from the side edge of the bag to the sections 43. The curved portions 42 each have respective sections 43 located under the patch 24 and sections 45 which are not covered by the patch 24 but which extend downwardly from the side edge of the bag to the sections 43. To more clearly illustrate the position and extent of first. second and third gusset folded top edge sections, respectively features 46, 43, 45, a larger scale detail from FIG. 3 is shown in FIG. 3A. In FIG. 3A, lead lines solely to features 46, 43, 45 are shown, these including spurs directed to dotted lines showing the extent of these gusset top edge sections.

The patch 24 has one face ply (hidden in FIGS. 2 and 3) of heat sealable thermoplastic polyethylene (PE) and the other face ply (exposed in FIGS. 2 and 3) of heat stable polyester (PET). In the course of manufacture, and before the front and back panels 12, 14 are seamed together, the gusset 16 is folded flat against the back panel 14 and the patch 24 is positioned to overlap a top portion of the folded gusset so as to leave exposed a section 33 of the back panel side edge portion 34. In a common seaming operation, the PE face ply at a top part of the patch 24 is thermally welded to the back panel 14 at region 52 and a PE face ply at the top of gusset side 28 is thermally welded to the back panel 14 below region 52. The front panel 12 is folded or otherwise held away from the seam region while seaming takes place in order that a thermal seaming tool can be pressed against the patch 24. Once the patch 24 is welded into place so as to close off the gusset 16 at its top, a second seaming operation is implemented to seam the back and front panels 12, 14 at the side regions 34, 38, the upper side regions 22 and the exposed section 33.

As an alternative manufacturing process (not shown) a tape strip material is used instead of a discrete patch, the tape strip material having a 3 ply laminate of PE/PET/PE, so that each face ply can be thermoplastically welded. In the process, webs for each of the back panels, front panels and folded gussets are fed continuously through cutting and seaming stations, with completed bags being successively cut away from the advancing webs. In the course of the manufacturing process, the tape strip is positioned across the advancing webs. In a first seaming operation, one face of a strip length is seamed partly against the back panel web and partly against the folded gusset similarly to the previously described patch process. However, in a subsequent seaming operation, the one face of another section of the strip is seamed to the side edge portion of the back panel while the other face of the strip section is seamed to the side edge portion of the front panel. In this process too, the front panel web is folded or moved out of the way to allow the seaming tool to effect the first seaming step.

As illustrated in FIG. 1, the angle at which the gusset curved edge portion 42 intersects the side of the bag 10 is about 20 degrees to the line of the side edge. If an attempt is made to lift the bag using the corner as a handle, there is a reactive force shown generally as F having a vertical component owing to the weight of the bag and a horizontal component owing to the center of gravity of the bag being spaced inwardly from the side edge. If the two components combine to present a reactive force at 20 degrees to the side edge, the force at the side edge is purely along or parallel to the seam line, where the top edge of the gusset joins the back panel, rather than across the seam line. A reactive force transverse to the seam line is more likely to cause damage to the seam than a force parallel to the seam line. Clearly, the way in which the bag is grabbed at a corner may alter the particular direction of the reactive force. An angle of intersection somewhat greater or less than 20 degrees therefore offers some resistance to tearing in comparison, for example, with a seam line that intersects the side edge orthogonally.

As shown in FIGS. 1 to 4, the seam line at the top of the gusset curves away from the side edge. The curved formation 42 further supplements the resistance to tearing. Thus, the reactive force will have a component transverse to the seam line having a certain magnitude at one part of the curve but, because of that curvature, will have a component transverse to the seam line having a different magnitude at a different part of the curve.

Figure 5:
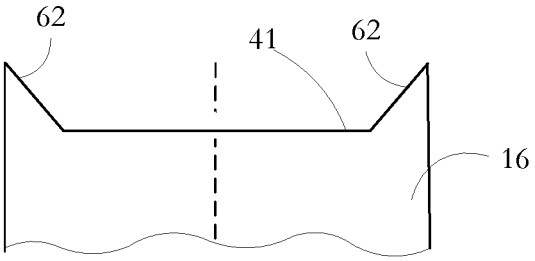
FIG. 5 shows the shape of a gusset top edge according to an embodiment of the invention.
Figure 6:
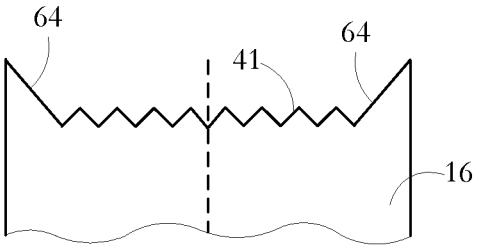
FIG. 6 shows the shape of a gusset top edge according to another embodiment of the invention.
Figure 7:
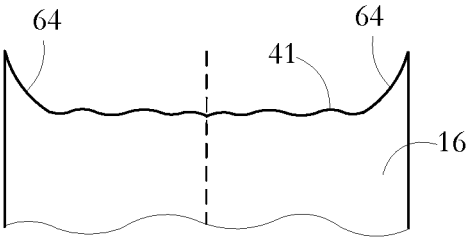
FIG. 7 shows the shape of a gusset top edge according to a further embodiment of the invention.
Figure 8:
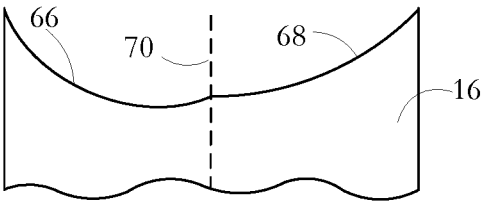
FIG. 8 shows the shape of a gusset top edge according to yet another embodiment of the invention.
Figure 9:
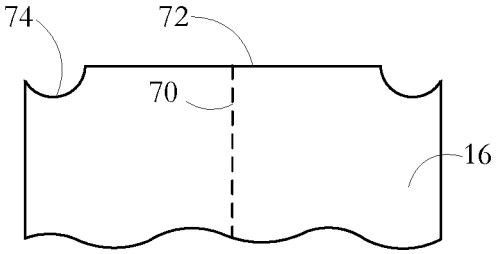
FIG. 9 shows the shape of a gusset top edge according to one more embodiment of the invention.

Referring to FIGS. 5 to 8, there are shown other forms of gusset 16, with the gusset shown in unfolded condition. Each of the gusset top edges is shaped to provide tearing resistance in the event the bag corner is grabbed owing (a) to the seam line intersecting the bag side edge at an angle that departs materially from a right angle and (b) to the seam line being non-linear. In each of the embodiments, the gusset top edge 41, where it intersects the bag side edge, extends downwardly from the side edge. In FIG. 5, sections 62 of the gusset top edge slope sharply down from gusset side edges but then extends horizontally over a central part of the top edge. In FIGS. 6 and 7, the top edge of the gusset is respectively of zig-zag and generally sinusoidal form with tongue portions 64 projecting upwardly to meet the gusset side edges. For manufacturing convenience, the gusset is made symmetrical about a vertical center line. However, a non-symmetrical gusset such as that shown in FIG. 8 also provides tear resistance. In this embodiment, the two halves 66, 68 of the top gusset edge are misaligned when the gusset panel is folded on the center line 70. To inhibit tearing in the neighbourhood of the gusset top edge, it is important that a tear does not even start. Consequently, the nature of the intersection of the gusset top edge with the bag side edge is equally important since this is where any tear is prone to start. In the embodiment of FIG. 9, the gusset top edge is generally linear as shown by the section 72 extending generally orthogonally to the bag side edge. However each of the gusset sides 28, 32 is interrupted by a cut out 74 close to the shape of a half circle. The cut out 74 is stamped out of the sides 28, 32 of the folded gusset 16 before the gusset is fixed into place as previously described. It will be seen that the cut out 74 is small and localized compared with the specialized gusset top edge shapes described in FIGS. 4 to 8. However, the cut out formation offers both the desired angle of intersection with the bag side and a curved contour of the gusset top edge near its intersection with the bag side edge.

The bag 10 is formed from sheet plastic material that is at least partly thermoplastic film material with seams between edges of panels being effected by hot press thermal welding. Such materials include, by way of example and not limitation, polyolefins such as polyethylene and polypropylene, vinyl polymers, and the like. The materials may be low-, medium- or high-density polymers and may be single or multi-layer composite material. Composite laminated materials may include adhesive layers. Sealing resins such as ethylene vinyl acetate may be used to improve sealing of certain polymer layers and the use of such sealing resins may obviate the use of adhesive tie layers. Thermoplastics film materials are contemplated which are made of or which include, a barrier sheet material such as a metal or Ethylene vinyl alcohol (EVOH) copolymer for inhibiting the transmission of gases through the film material. The thickness of the film material is selected mainly on the basis of the intended weight the bag must carry and generally ranges from about 2 to 20 mils. The type of thermoplastic sheet material used depends on the purposes to which the bag, or the relevant part of it, is to be put, whether it is easy to handle in manufacturing, whether it can be readily printed upon, whether it is waterproof, and whether it is strong enough to resist tearing or bulging, etc.

The patch 24 or tape strip is made of a material having properties selected to offer strength and tear resistance. In one embodiment of the invention, the patch material is stronger than the material used in making the bag panels 12, 14 while in another example, it is thicker that than the panel material. In a further example, the patch material has relatively thick PE layers flanking a high strength nylon core layer. A thick and/or strong patch or strip material assists particularly in inhibiting the creation of a tear through the front panel and the patch (or tape strip).

In the course of bag manufacture, one seam is left open to allow customers to fill the bag, this seam then being welded by the customer to close and if necessary to seal the bag after the bag is filled. The seam that is most conveniently left open for shipping and later filling is at the bag top edge. In the slide fastener example shown, the slide fastener device consists of two end tabs 54, one of which is shown, and a web 56 extending between two plastic extrusions 58 bonded to the web 56. To install the fastener device following seaming of the front and back panels together at the top of the bag, the tabs 54 are fixed to respective corners of the bag and one side of the web 56 is thermally welded to the back panel 14 at the region 60, the slider device 18 is then clipped onto the two extrusions 58 so that moving the slider in one direction along the extrusions 58 brings the extrusions together to close the top of the bag, while moving in the opposite direction forces the extrusions apart. At this time during manufacture, the other side of the web 56 is not welded to the front panel 12 so as to leave the interior of the bag accessible at the space between the web 56 and the front panel 12. Once the bag is filled, the front panel 12 and the side of the web 56 are seamed together. After the filled bag is sold and the buyer wants to access the contents, he or she moves the slider 18 in a direction such as to force the extrusions 58 apart to reveal the web 56. The web 56 is then slit along its center to allow access to the bag contents. Later, when some of the contents have been removed, the buyer moves the slider 18 in the opposite direction to reclose the bag.

In the previously illustrated embodiments, the side edge 39 (FIG. 1) and the side edges of the panels 12 and 14 where they are seamed to the gusset sides 28, 32 (FIG. 2) are vertical in normal carrying mode. Although unusual, plastic bags having non-vertical sides are also possible. The carrying of weight in such bags acts to subject the front and back panels and the gusset to tension. In such embodiments, the top edge of the side gusset 16 at its junction with the non-vertical side edge extends substantially non-orthogonally to the direction of tension.

Other variations and modifications will be apparent to those skilled in the art. The embodiments of the invention described and illustrated are not intended to be limiting. The principles of the invention contemplate many alternatives having advantages and properties evident in the exemplary embodiments.

What is claimed is:

1. A bag made of plastic film material having a front panel, a back panel, a top, a bottom and a gusset at one side of the bag having a top edge terminating short of a top edge of the bag, a first inside edge portion of the gusset seamed to a second inside edge portion of the back panel at a first seam area at said one side, a third inside edge portion of the gusset seamed to a fourth inside edge portion of the front panel at a second seam area at said one side, the front panel having a fifth inside edge portion seamed to a sixth inside edge portion of the back panel at said one side to form a third seam area extending between the top edge of the bag and the first and second seam areas, the gusset extending between said first and second seam areas at said one side and having an expansible region thereof provided by sides of the gusset, the gusset sides folded against the back panel at the gusset top edge to form, at each gusset side, first, second and third gusset top edge sections, a plastic film material patch having a first patch part contiguous with a second patch part thereof, the first patch part contiguous with the second seam area and thermally welded below the first and second gusset top edge sections to the folded gusset, the second patch part being contiguous with the third seam area and thermally welded above the first and second gusset top edge sections to the back panes, the first and second seam areas contiguous with the third seam area at the third gusset top edge sections contiguous with respective ones of the second gusset top edge sections, the third gusset top edge sections extending downwardly towards a bag interior from a side edge of the bag at a lower end of the third seam area.

2. A bag as claimed in claim 1, wherein at least one of the third gusset top edge sections intersect the side edge at an angle of between 70 degrees and 20 degrees to the line of the side edge.

3. A bag as claimed in claim 2, wherein at least one of the third gusset top edge sections is generally linear at its intersection with the side edge.

4. A bag as claimed in claim 2, wherein at least one of the third gusset top edge section is curved at its intersection with the side edge.

5. A bag as claimed in claim 1, the gusset arrangement at the top of said one side of the bag being generally mirrored by a second gusset arrangement at the top of the other side of the bag.

6. A bag as claimed in claim 1, the gusset arrangement at the top of said one side of the bag being generally mirrored by a second gusset arrangement at the bottom of said one side of the bag.

7. The bag as claimed in claim 1, wherein the patch has one face ply of heat sealable material and the other face ply of non-heat sealable material.

8. The bag as claimed in claim 1, wherein the patch has heat sealable face plies at each face thereof.

9. The bag as claimed in claim 1, wherein the patch is spaced inwardly from said side edge.

10. The bag as claimed in claim 1, wherein the first gusset top edge sections curve upwardly towards the bag interior.

* * * * *